US005839601A

United States Patent [19]

Van Melle

[11] Patent Number: 5,839,601

[45] Date of Patent: Nov. 24, 1998

[54] DISPOSABLE DOME LID FOR DRINKING CUPS

[75] Inventor: Hugh Van Melle, Mississauga, Canada

[73] Assignee: Amhil Enterprises, Mississauga, Canada

[21] Appl. No.: 768,810

[22] Filed: Dec. 18, 1996

[51] Int. Cl.[6] ..... A47G 19/22

[52] U.S. Cl. ..... 220/712; 220/254; 220/268; 220/335; 220/389; 220/714; 220/717

[58] Field of Search ..... 220/335, 337, 220/339, 796, 799, 800, 801, 802, 703, 717, 711, 712, 254, 266, 268, 269, 714, 716

[56] References Cited

U.S. PATENT DOCUMENTS

| | | | |
|---|---|---|---|
| 2,002,458 | 5/1935 | Sebell | 220/801 |
| 3,977,559 | 8/1976 | Lombardi . | |
| 3,994,411 | 11/1976 | Elfelt et al. . | |
| 4,106,660 | 8/1978 | Boyle . | |
| 4,184,604 | 1/1980 | Amberg et al. | 220/254 |
| 4,202,459 | 5/1980 | DeParales et al. . | |
| 4,244,490 | 1/1981 | Klein | 220/268 |
| 4,322,015 | 3/1982 | Bailey . | |
| 4,421,244 | 12/1983 | Van Melle . | |
| 4,460,103 | 7/1984 | Rama et al. . | |
| 4,473,167 | 9/1984 | Bailey . | |
| 4,502,608 | 3/1985 | Mills . | |
| 4,566,605 | 1/1986 | Rogers . | |
| 4,589,569 | 5/1986 | Clements . | |
| 4,615,459 | 10/1986 | Clements | 220/254 |
| 4,627,537 | 12/1986 | Rogers . | |
| 4,629,088 | 12/1986 | Durgin . | |
| 4,738,373 | 4/1988 | DeParales . | |
| 4,793,516 | 12/1988 | Niwa et al. | 220/335 X |
| 4,925,050 | 5/1990 | Yu | 220/716 |
| 5,111,961 | 5/1992 | Van Melle . | |
| 5,183,172 | 2/1993 | Boller | 220/712 X |
| 5,193,722 | 3/1993 | Groya et al. | 220/335 X |
| 5,301,830 | 4/1994 | Muller | 220/906 X |
| 5,392,949 | 2/1995 | McKenna . | |
| 5,398,843 | 3/1995 | Warden et al. | 220/711 |
| 5,409,131 | 4/1995 | Phillips et al. | 220/717 |
| 5,490,609 | 2/1996 | Lane et al. . | |
| 5,624,053 | 4/1997 | Freek et al. | 220/713 |

*Primary Examiner*—Stephen K. Cronin
*Assistant Examiner*—Robin A. Hylton
*Attorney, Agent, or Firm*—Donald E. Hewson

[57] ABSTRACT

A disposable dome lid is provided for use with a drinking cup such beverage cups used for the sale of hot and cold beverages. The top surface of a dome lid is elevated above the top surface of the beverage cup rim, when in place. The dome lid is configured so as to make a plug fit onto the beverage cup by the beverage cup rim extending into a downwardly facing recess formed for that purpose. A side surface depends downwardly from a substantially planar top surface of the lid, and is inset from the cup rim engaging recess. A portion of the side surface is displaced outwardly towards the outer periphery of the dome lid, and thus provides a surface for engaging the lower lip of the mouth of the user. A tear-back flap is defined by fault lines stamped into the top surface and a "U"-shaped hinge formed in the top surface. When the tear-back flap is folded back, a locking stub extends downwardly into a locking recess formed in the top surface of the lid, and a drink-through opening is thereby created in the top of the dome lid near the outer periphery thereof, for easy drinking access to the beverage in the cup.

18 Claims, 2 Drawing Sheets

DISPOSABLE DOME LID FOR DRINKING CUPS

FIELD OF THE INVENTION

This invention relates to disposable lids for beverage cups; and, more particularly, the present invention is directed to disposable dome lids which may be placed over the mouth of a beverage cup and which provides a drink-through opening in the top surface of the beverage cup lid for easy drinking access to the beverage.

BACKGROUND OF THE INVENTION

Disposable dome lids for beverage cups are very often desirable for use because of certain advantages that they offer. In particular, when a disposable dome lid is used with a beverage cup in which cold beverages are served, it provides a space above the rim of the beverage cup into which floating ice within the beverage cup, when it is first filled, may protrude. This gives the merchant the opportunity to use larger ice cubes or chunks of crushed ice than he may normally use, while still providing a fill measure of dispensed beverage; and likewise, it gives the consumer the sense that he/she has received full measure of the beverage while also receiving enough ice to keep the beverage cold over a longer period of time. Typically, access to the beverage is obtained by pushing a straw through a cross-shaped slit which is stamped into the dome lid for that purpose.

Another advantage of dome lids is that they may contain a froth or foam such as the head which is formed on draft beer when it is dispensed into a beverage cup for sale such as at a ball park or the like.

However, dome lids have an even more significant value when used with hot beverages such as coffee or tea, and in particular, with beverages such as cappuccino. The use of a dome lid permits the steam which rises from the hot beverage, especially when it is first dispensed, to rise and collect within the volume provided by the dome lid, thereby possibly decreasing pressure being formed within the substantially sealed cup when a lid is in place. There is usually a steam release hole which is punched into cup lids for use with hot beverages, but sometimes it may clog or be covered if several filled beverage cups are placed or are carried together in stacked relation. Moreover, the additional volume above the rim of the cup permits some space for the hot beverage to slosh around in, such as when a cup of dispensed hot beverage is being carried. This may help to preclude inadvertent spillage of the hot beverage past the rim of the cup, thereby causing discomfort to the hand of the person carrying it, or causing wet spillage in a paper bag or the like. Sometimes, in such circumstances, especially when the filled beverage cup is being subjected to external shaking forces, the disposable lid might become dislodged; and the use of a dome lid will reduce those possibilities.

However, heretofore, the use of dome lids with hot beverage cups, in particular, has resulted in several other disadvantages. For example, dome lids that have offered an opportunity for presenting a drink-through opening, have had a small oval-shaped opening of no substantial size, so that easy drinking access to the beverage was difficult. Moreover, dome lids have, generally, been fitted to the rim of a beverage cup merely by being placed thereover, with somewhat of an interference fit between the interior edge of the dome lid at its bottom, and the outer edge of the lip of the cup. Such placement is insecure; a cup lid having a so-called "plug fit" provides a much more secure placement of the lid on a beverage cup.

Briefly, what is meant by a plug fit is that a recess is formed on the underside of a beverage lid, near or at the outer periphery thereof, and the recess accommodates the lip of the beverage cup at both its inside and outside extremities, so that the cup lid extends into the recess, and is much more securely held into place.

However, dome lids having plug fit recesses, particularly for use with hot beverages, are not readily available in the market, if at all.

Moreover, dome lids having a specific tear-back flap, as opposed to a punched hole which provides a drink-through opening, are unknown. The advantages of a tear-back flap over a punched opening include, of course, the fact that a beverage cup having a lid with a tear-back flap remains sealed, whereas a beverage cup having a punched opening in the lid affixed to it is unsealed and spillage could easily occur.

Another disadvantage of dome lids, as they have been known heretofore, is that access to the beverage to be consumed either occurs automatically because of the previously punched opening, or requires insertion of a straw through such as a slit or punch-out hole; and the latter operation demands the use of two hands. Also, a straw would not be used with hot beverages such as coffee.

The present invention, however, provides a dome lid which overcome the disadvantages described above, and provides a number of advantages and features. For example, in one preferred embodiment of the dome lid of the present invention, access to a drink-through opening is achieved using one hand, by pressing against a more or less vertically disposed wall, causing a tear-back flap which is defined in the upper surface of the dome lid to pop up. The tear-back flap can then be folded back and locked or secured into place by easy manipulation of the thumb of the single hand holding the beverage cup.

In another preferred embodiment of the present invention, there is provided an easily grasped gripping stub, which will also function as a locking stub to secure the tear-back flap in place in its folded back position. Moreover, the tear-back flap can be positioned so that the outer edge of the drink-through opening that it defines is positioned so as to be at or very near a more or less vertically disposed wall, so that a drinking action is easier to perform.

Another advantage that is achieved from the present invention is that the lid may be much more securely fastened or affixed to the beverage cup because it has a plug fit attachment. This provides greater assurance that there will be no inadvertent dislodgement of the cup lid away from the cup.

Still further, cup lids of the present invention may be placed over the rim of coated paper cups having a rolled rim, or over the rim molded polystyrene foam cups.

Moreover, due to their configuration, a significant number of identical cup lids in keeping with the present invention may be stacked with a relatively low stacking height.

These and other features and advantages of dome cup lids, in keeping with the present invention, are described in greater detail hereafter.

DESCRIPTION OF THE PRIOR ART

There are two United States patents which provide certain basic teachings of some features of the dome cup lids of the present invention, but which teach cup lids that are not otherwise suitable for purposes of the present invention. These patents are, however, referred to for purposes of establishing basic knowledge as to the prior art.

RAMA et al U.S. Pat. No. 4,460,103 provides a drink lid or cover which is particularly intended for use with cups having hot beverages in them, and which fits snugly to the cup in a non-spill manner while providing an openable flap through which ingredients such as cream and sugar may be added to the beverage, and through which the beverage may be consumed. However, the Rama et al drink lid is substantially flat, having an upper surface which extends downwardly into the cup so as to lie below the surface of the rim of the cup. A raised pull tab is provided to lift the flap so that it may be folded back, after which the pull tab is then inserted into a matching well. Manipulation of the pull tab is the only way that the flap may be opened, and presents significant difficultly for persons having weak hands, hands which are either too large or too small, or on which gloves are worn, or for which dexterity of manipulation may be difficult using bare hands in cold weather. However, the lid is such that, when it is first put into place, there is little likelihood of a spill occurring, or of the lid becoming dislodged from the cup.

CLEMENTS U.S. Pat. No. 4,589,569 teaches a dome lid which is placed over the rim of a beverage cup, and which extends above the rim of the beverage cup so as to provide additional volume for such purposes as to protect against spillage. However, the Clements drink lid has a preformed punched opening which is very small and which is located in an elevated rim formed in the cup lid. Several disadvantages arise, including the fact that the preformed opening may not preclude spillage due to jostling of the cup. Moreover, the lid is not plug fitted to the cup, but is merely snapped over the rim of the cup with engagement between the rim and the cup lid being limited only to the upper and outer portion of the cup rim being contacted by the cup lid. Still further, the very small preformed drinking opening is awkward to use, in that it is quite small and, when the beverage is very hot, a thin stream of hot beverage is directed into the mouth of the user. Still further, the small drinking opening does not permit air to flood back into the cup while the beverage is being consumed, and a vent hole must be provided for that purpose. If the vent hole is poorly formed, or clogged, the beverage must be more or less sucked from the cup through the drinking opening unless the cup is taken away from the mouth of the user so as to permit air to re-enter the cup through the drinking opening.

The Clements patent discusses the possibility of score lines being provided so as to define a removable portion to enable a drinking opening to be formed by the user; but the patent is specifically silent as to how such score lines would be accomplished. Physical examples of the drinking cup lid of the Clements patent are known in the field, which follow the otherwise described and illustrated embodiment of the patent, but none is known having a removable portion formed therein so as to permit a drinking opening to be provided. Indeed, no such cup lid otherwise in keeping with the general teachings of the Clement patent is known ever to have existed, due to the profound difficulties in providing the same.

Another United States patent which teaches a beverage cup lid, but not a dome lid, having a fold-back closure member which may be lifted up and secured in a folded back position using a lifting knob or stub, is LANE et al U.S. Pat. No. 5,490,609. However, the closure member must be manipulated during manufacture of the cup lid so that the edge of the closure must be locked into place by being tucked under another portion of the lid.

SUMMARY OF THE INVENTION

In accordance with one aspect of the present invention, there is provided a disposable dome lid which is intended for placement on a drinking cup or the like which has an opening at its upper end, where the opening in the cup is defined by a substantially circular cup rim whose upper extremity lies substantially in a single plane. The disposable dome lid is vacuum formed from extruded plastics sheet material, as discussed hereafter, and comprises a substantially circular planar top surface, a side surface which depends downwardly from the top surface, and a downwardly facing cup rim engaging recess which is formed near the outer periphery of the disposable dome lid. The cup rim engaging recess is defined at its outer side by a substantially circular, downwardly depending apron, and at its inner side by a downwardly directed recess side wall. The recess side wall and the downwardly depending side surface both extend into an upwardly facing recess which is located below the top surface of the cup lid, and they intersect at the bottom of that upwardly facing recess.

A portion of the substantially circular top surface is displaced and extends outwardly, and terminates at a lower lip engaging surface which depends downwardly therefrom, and which has a side edge at each side thereof. The lower lip engaging surface merges at each of its side edges with the side surface which depends downwardly from the top surface in the remaining periphery thereof.

A depressed "U"-shaped hinge is formed in the top surface, and is spaced away from and is substantially parallel to the lower lip engaging surface. Fault lines are stamped into the substantially planar top surface so as to define a tear-back flap which, when torn back, will fold backwardly at the "U"-shaped hinge. When the tear-back flap is thus folded back, it thereby defines a drink-through opening in the top surface in a region thereof which is adjacent the lower lip engaging surface.

Conveniently, the tear-back flap is defined by three fault lines, which comprise an outer fault line and two edge fault lines. The edge fault lines extend away from the respective ends of the outer fault line, towards the "U"-shaped hinge, and they terminate at the "U"-shaped hinge.

Preferably, there is formed in the tear-back flap an upwardly extending locking stub, near the outer edge of the tear-back flap. It is formed at a defined distance from the "U"-shaped hinge; and there is a locking recess which is formed in the substantially planar top surface at the other side of the "U"-shaped hinge from the locking stub and also substantially at the defined distance from the "U"-shaped hinge. Thus, when the tear-back flap is torn back by breaking the fault lines, and it is folded about the "U"-shaped hinge, the locking stub will engage in the locking recess to secure it in place.

In general, the dimensions, either width or length, or both, of the locking stub and locking recess are chosen so that the locking stub will be retained in the locking recess by interference fit of the edges of each against the other.

In another feature of the present invention, the lower lip engaging surface may be slightly concave in plan view, with respect to the outer periphery of the lid, so that it will conform to the contour of the lower lip of a user when the disposable dome lid is in use on a drinking cup.

Of course, several of these features will generally appear together in dome lids in keeping with the present invention.

In one embodiment of the present invention, the outer fault line which defines the tear-back flap may be stamped so as to be slightly convex in plan view with respect to the outer periphery of the lid; and, generally, the outer fault line and the lower lip engaging surface are formed so as to substantially share the same axis of symmetry. Thus, the lower lip engaging surface and the outer fault line diverge in plan view away from each other, about the axis of symmetry.

In another embodiment of the present invention, the outer fault line which defines the tear-back flap is placed at or very near the outer periphery of the lid, in its upper region, so as to provide a drink through opening an a lower lip engaging surface immediately below the outer edge of the opening so that an easy drinking process may be followed.

In any embodiment of this invention, each of the side surface and the lower lip engaging surface generally extend downwardly and somewhat outwardly from the planar top surface of the cup lid. As noted hereafter, this will provide ease of stripping of the cup lids from male molds as they are vacuum formed, or from within female molds if such a process is chosen to be followed; and, in any event, stackability within a lower stacking height for a plurality of like disposable dome lids of the present invention, may be achieved.

Still further, because of the geometry of disposable dome lids of the present invention, whereby the downwardly depending apron which is formed at the outer periphery of the cup lid extends entirely around its periphery, and whereby the downwardly directed recess side wall which forms the inner side of the cup rim engaging recess is interrupted only in that portion where the lower lip engaging surface is located, a secure plug fit of the disposable dome lid of the present invention to a drinking cup is assured.

It will be understood, of course, that terms such as top, upwardly, downwardly, lower, etc., are to be read in their usual sense having regard to the usual placement of the lid on a beverage cup, at the top thereof.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

There now follows a more detailed description of certain features of disposable dome lids for drinking cups, as provided by the present invention, together with a discussion as to how the advantages of such disposable dome lids are achieved.

Figure 1:
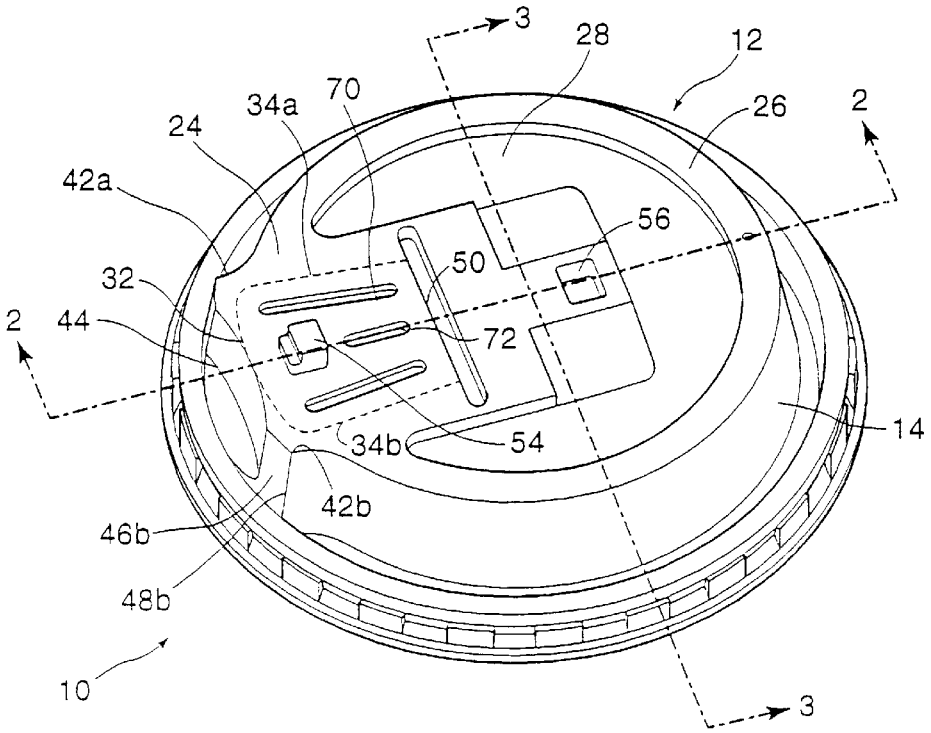
FIG. 1 is a perspective view of a typical disposable dome lid of the present invention.

A first embodiment of disposable dome lid according to the present invention is shown generally in FIG. 1 at 10. A second embodiment, discussed hereafter, is shown generally in FIG. 4 at 80. However, common features of any dome lid, in keeping with this invention, are referred to hereafter using the same reference numerals, for ease of understanding.

Typically, the disposable dome lids of the present invention are vacuum and pressure formed from extruded polystyrene material. A thin sheet of polystyrene is extruded and, while still hot, is conveyed into a vacuum/pressure molding station where the plastics material is vacuum/pressure molded using male or female dies. The plastic sheet material is pulled by vacuum over male dies, or into female dies; it is then permitted to cool for a brief period of time, and is then stripped from the die.

After the web or sheet material has been stripped from the die—usually, a plurality of dies for a plurality of lids is used at one time—it is then stamped so as to cut the lids from the sheet material. At the same time, or in a separate stamping step, fault lines may be stamped so as to define the tear-back flap feature of the present invention as discussed hereafter.

Either disposable dome lid 10 or 80 is generally circular in configuration, and has a substantially planar top surface shown generally at 12, a side surface 14 which depends generally downwardly from the top surface 12, and an outer apron 16. There is a downwardly facing cup rim engaging recess 18, which is formed near the outer periphery of the dome lid 10 or 80, and substantially all around the periphery except as noted hereafter. The cup rim engaging recess 18 is defined at its outer side by the apron 16, and at its inner side by a downwardly directed recess side wall 20. Except as noted below, the recess side wall 20 and the side surface 14 both extend into an upwardly facing recess 22, and the extensions of the recess side wall 20 and the side surface 14 intersect at the bottom of the upwardly facing recess 22. There is thus formed substantially around the periphery of the disposable dome lid of the present invention a cup rim engaging recess 18 which assures that the disposable dome lid may be securely attached to a drinking cup.

While the top surface 12 is substantially planar, at least in general appearance, it does comprise a number of distinct features, some of which are as follows: In particular, there may be noted a first planar portion 24 and a co-planar rim portion 26, below which there may be formed a slight depression 28. In any event, in the first planar portion 24 of the dome lid 10, which planar portion 24 is formed substantially at one side of the cup lid and which extends more or less from the center thereof to the outer periphery, as described hereafter, there are stamped fault lines 32, 34*a*, 34*b*, which will define a tear-back flap 36. The first planar portion 24 is displaced and extends outwardly from what would otherwise be the circular outer periphery of the upper rim 26, thereby forming an extension 40, which has outer extension edges 42*a*, 42*b*. The outer extremity of the extension portion 40 terminates at a top edge which will define a lower lip engaging surface 44. As well, the lower lip engaging surface 44 may have a pair of additional side extension surfaces of which only 46*b* is shown. In any event, the lower lip engaging surface is defined at its outer sides by side edges, of which only side edge 48*b* is shown. It will be seen that the general configuration of the lower lip engaging surface region of the dome lid 10 of the present invention is such that it merges at each of its side edges with the side surface 14, forming edge surfaces of which only 14*b* is shown, and which subtend outer extension edges 42*a* and 42*b*, respectively.

It should be noted that the term "lower lip engaging surface" is used in the present context to denote a surface formed in the dome lid 10 of the present invention, against which the lower lip of the user is placed when consuming a beverage. This surface, therefore, serves the same purpose as the outer surface of a cup or glass during a normal drinking procedure.

A depressed "U"-shaped hinge 50 is formed in the top surface 12 within the region 24; and within the portion of the region 24 that will be defined as the tear-back flap 36 there is also formed an upwardly extending locking stub 54. At the other side of the "U"-shaped hinge 50, and in line with the locking stub 54, there is a locking recess 56, whose purpose is to receive the locking stub 54 and to retain the locking stub 54 therein in a manner as discussed hereafter.

Figure 2:
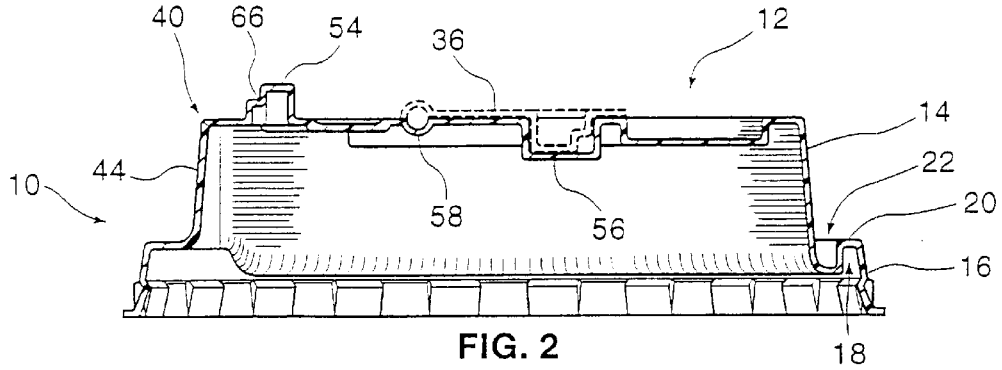
FIG. 2 is an elevational cross-section in the direction of arrows 2—2 in FIG. 1.

It is evident that, when the tear-back flap 36 is folded back in the manner shown in dashed lines in FIG. 2, a drink-through opening 60 will be formed in the top surface in the region 24 which is adjacent the lower lip engaging surface 44. The drink-through opening 60 is, of course, defined at its edges by the plastic material located at the fault line 32 and the fault lines 34*a*, 34*b*, and as well as by the plastic material in the region of the "U"-shaped hinge 50.

It will be evident that the drink-through opening 60 is of a size that is sufficient to provide easy drinking access to the beverage within a drinking cup to which the disposable dome lid has been attached, permitting air to easily enter into the cup as the beverage is consumed therefrom, and thereby permitting a more usual drinking procedure rather than an essentially sucking procedure as may be required when beverage is consumed through the preformed and punched opening in a lid such as that shown in Clements U.S. Pat. No. 4,589,569, noted above.

As previously stated above, the step by which fault lines 32, 34*a*, 34*b* are stamped may occur at the same time that the vacuum molded disposable dome lid is stamped out of the web of sheet material from which it has been formed, or in a separate step which may occur either before or after the dome lid is stamped out of the sheet plastics material. In any event, the stamping is generally carried out using a pair of complimentary dies. The plastics material in the region bounded by the fault lines 32, 34*a*, 34*b* is slightly upset—that is, it is caused to occupy a slightly different plane than previously. This causes the plastics material in the region of each of the fault lines to fracture; however, there may be a number of small linking points distributed along each of the fault lines where the complimentary stamping dies are arranged to permit the material to slightly stretch rather than to shear, thereby maintaining the material substantially in place until such time as a specific action is taken by the user to fold back the tear-back flap and thereby reveal the drink-through opening.

That action, by the user, may be initiated as follows: By pressing against the lower lip engaging surface 44, that surface is caused to deflect slightly inwardly—to the right, as seen in FIG. 2. That deflection, in turn, will cause the front edge of the tear-back flap, at fault line 32, to pop up. Then, the tear-back flap can be folded back, with the remaining linking points fractured, simply by pushing upwardly and backwardly with the thumb at the edge of the tear-back flap defined by fault line 32. Moreover, the locking stub 54 may conveniently be profiled with an additional step shown at 66, and an additional lifting action can be achieved merely by pressing the thumbnail against the locking stub 54 in the region of the step 66. In any event, the tear-back flap may then be folded backwards around the "U"-shaped hinge 50, thereby revealing the drink-through opening 60.

Typically, one or more stiffening ribs 70 or 72, for example, may be formed in the tear-back flap 36, so as to provide stiffening for the tear-back flap in its longitudinal direction, towards the "U"-shaped hinge 50. This enhances the stiffness of the tear-back flap 36, especially while it is being folded back.

As noted above, the tear-back flap 36 may be secured in place by inserting the locking stub 54 into the locking recess 56. The placement of the edges of the locking stub 54 and the locking recess 56 which are nearest the "U"-shaped hinge, in each case, are substantially equidistant from the "U"-shaped hinge, so that the locking stub 54 will engage in the locking recess 56 in an appropriate manner.

To better assure that the tear-back stub may be secured in place, the dimensions of the locking stub 54 and locking recess 56 may be chosen so that at least one of the width, across the locking stub, and the length of the stub, in a direction towards the "U"-shaped hinge, and a corresponding at least one of the width and length of the locking recess 56, are such that when the locking stub 54 is inserted into the locking recess 56 it will be retained therein by an interference fit of the side edges or front-to-back edges of the locking stub 54 against the locking recess 56. Because of the step 66 formed in the locking stub 56, it is more convenient to assure a sideways interference fit of the locking stub 54 in the locking recess 56.

Preferably, the configuration of the lower lip engaging surface 44, or at least the central portion thereof, is slightly concave in plan view with respect to the outer periphery of the lid. Thus, as can be discerned from FIG. 1, the contour of the lower lip engaging surface 44 is such that it will more adequately conform to the contour of the lower lip of a user when the disposable dome lid 10 is in use on a drinking cup.

Moreover, the outer fault line 32 is preferably stamped in a manner so as to be slightly convex in plan view with respect to the outer periphery of the lid. Because of the placement of the lower lip engaging surface 44 and the fault line 32, it can be seen that each of them will have essentially the same axis of symmetry which can be imagined to be drawn through the center of the lid and through the center of each of the lower lip engaging surface 44, fault line 32, locking stub 54, "U"-shape hinge 50, and locking recess 56. By this geometry, the lower lip engaging surface 44 and the outer fault line 32 diverge in plan view away from each other, about the axis of symmetry. This geometry will enhance the popping up action whereby folding back of the tear-back flap 36 can easily occur. Such an action can, as noted, be accomplished using one hand.

Each of the lower lip engaging surface 44 and the side surface 14, and the associated structure which defines the dome lid and which lifts the upper surface 12 away from the rim engaging recess 18, is sloped downwardly and outwardly from the top surface 12. This permits easy stacking of a plurality of like dome lids, provided that they are oriented properly so that each of the lower lip engaging surfaces 44 is in alignment one with another. It also assures that the drink-through opening 60 will be quite close to the edge of the dome lid, so that the beverage may be consumed from the cup in a usual drinking manner.

It is also noted that the downwardly depending apron 16 extends entirely around the outer periphery of the disposable dome lid 10, and that the downwardly directed recess side wall 20 is interrupted only in the region of the lower lip engaging surface 20. Thus, a plug fit of the rim of the drinking cup into the rim engaging recess 18 is assured, with the exception of the small region defined by the lower lip engaging surface 44. However, because that region occupies no more than about 10° or 15° of the 360° circle defined by the apron 16, a secure plug fit is assured.

Figure 4:
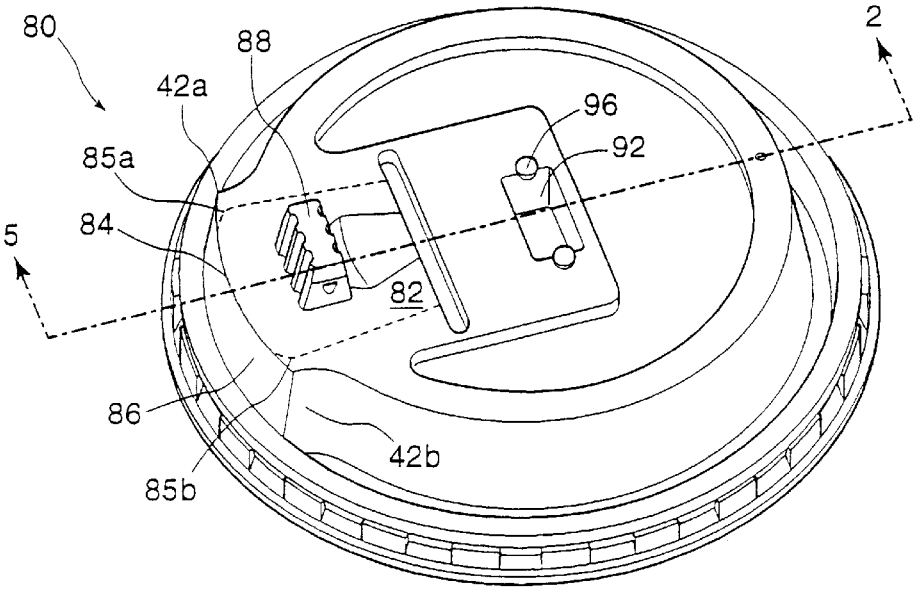
FIG. 4 is a view similar to FIG. 1 of another embodiment of disposable dome lid of the present invention.
Figure 5:
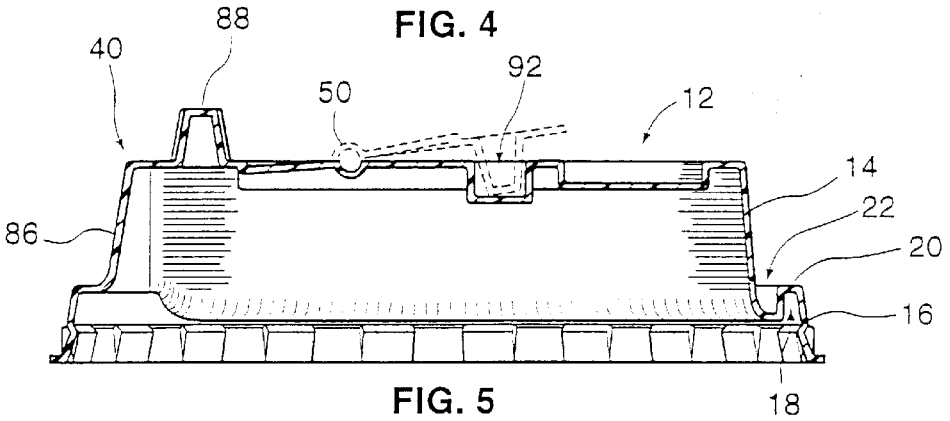
FIG. 5 is an elevational cross-section in the direction of arrows 5—5 in FIG. 3.
Figure 6:
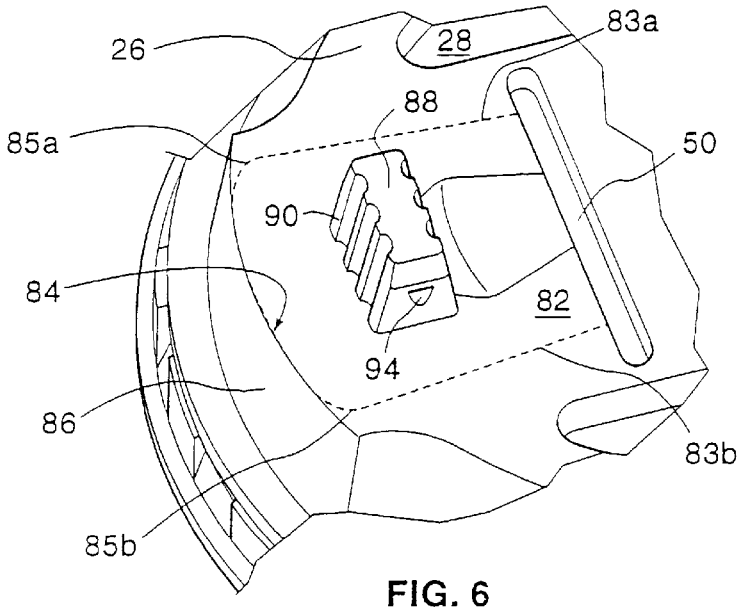
FIG. 6 is a partial perspective view, on a larger scale, of a portion of the dome lid of FIG. 4.

Referring specifically to FIGS. 4 through 6, a tear-back flap 82 is shown. It is bounded at its radially inward end by a "U"-shaped hinge 50, and it its radially outward end by a stamped fault line 84. However, the other two edges 83*a*, 83*b* of the tear-back flap 82 may also be stamped fault lines, or they may be simply formed as a consequence of tearing back the tear-back flap 82 along the fault lines formed in the polystyrene material of the cup lid when it is first extruded. Below the fault line 84 there is a lower lip engaging surface 86, which terminates the extension 40, and which is also defined by outer extension edges 42*a*, 42*b*. In dome lid 80, the lower lip engaging surface 86 subtends the fault line 84, and terminates at its upper limit substantially at the fault line 84.

Opening the tear-back flap 82, and tearing along the fault line 84 and the side edges 83*a*, 83*b* towards the "U"-shaped hinge 50, are promoted or facilitated by grasping on upstanding stub 88. The dimensions of the grasping stub 88 are such that it may be easily grasped between the thumb and a finger, and squeezed without collapsing. The front, or either edge, of the grasping stub 88 may be configured with a plurality of ridges 90, as shown in FIG. 6, for additional stiffness. In any event, grasping the stub 88 and lifting upwardly will cause the tear-back flap 82 to be formed, without the risk that the dome lid 80 will accidentally be dislodged from the beverage cup on which it is placed due to the plug fit of the beverage cup lid into the recess 18.

The grasping stub 88 fits into a recess 92, which is dimensioned to receive and retain the grasping stub 88 when it is inserted into the recess. A pair of small depressions 94 may also be formed into the sides of the grasping stub 88, and also a pair of small pips 96 may be formed at the edges of recess 92, to lock the depressions 94 and thus assist to hold the tear-back flap 82 in its folded back orientation. Of course, the pips 96 and depressions 94 may also be formed in the grasping stub 88 and in the edge surfaces of the recess 92, respectively.

When the tear-back flap 82 is opened, a drink-through opening is formed. An easy drinking procedure may follow, simply by placing the lower lip engaging surface 86 against the lower lip, and drinking as if out of a cup or glass without the presence of a dome lid in place thereon. When the tear-back flap 82 is folded into its original, unopened orientation, the edges 83*a*, 83*b* thereof will engage the remaining edges surrounding the drink-through opening. This will not necessarily seal the drink-through opening, but the loss of steam or beverage vapour, and the risk of hot liquid splashes exiting the cup as it is moved about, are considerably reduced.

There has been described several embodiment of disposable dome drinking lids for use with beverage cups, and which is particularly useful when attached to the rim of a beverage cup containing a hot beverage. The advantages of the use of dome lids, with a top surface which is elevated above the rim of a cup, have been described; however, in contradistinction to the prior art dome lids, the present invention provides a drink-through opening of a reasonable size whereby an ordinary drinking process can be followed. Additives, such as cream and sugar, can be placed in the drinking cup through the drink-through opening; and, during the drinking process whereby the beverage is consumed, there is no necessity to stop drinking to permit air to come back into the cup, and there is no necessity therefore to essentially suck the beverage from the cup.

The tear-back flap of one embodiment of the present invention may be opened by a single hand, merely by pressing against the lower lip engaging surface in the first instance, and then folding the tear-back flap back using the thumb so as to secure it in place by the locking stub engaged in the locking recess. Otherwise, the tear-back flap may be opened by means of an easily engaged grasping stub.

Typically, the disposable dome lids of the present invention are vacuum formed from extruded polystyrene sheet material, but other suitable materials may be used, including vinyls and polyvinylchloride materials that may be vacuum formed.

Figure 3:
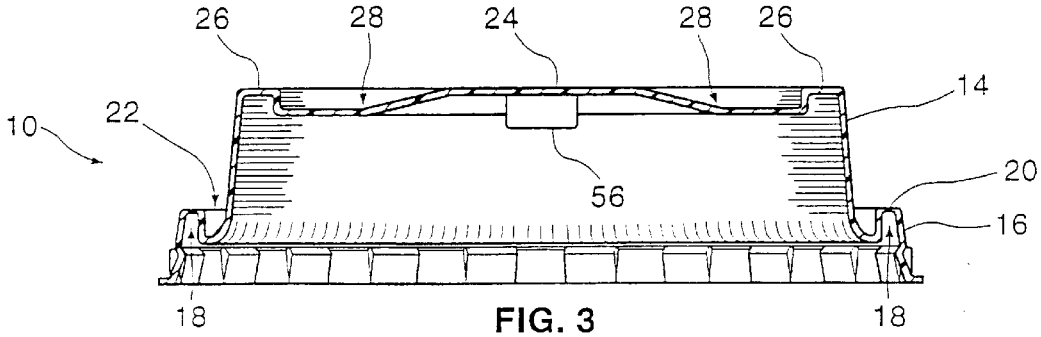
FIG. 3 is an elevational cross-section in the direction of arrows 3—3 in FIG. 1.

It has been the usual practice for disposable drink lids having a tear-back flap to be formed in such a manner that the edges of the tear-back flap are more or less co-linear with the linear extrusion grain formed in the sheet polystyrene material as it is extruded. However, in the case of the dome lids of FIGS. 1 through 3, because the fault lines 32, 34*a*, 34*b* are stamped into the material, as described above, it is less important that the axis of the dome lid from left to right as shown in FIG. 1 is aligned with the extrusion grain of the material from which the dome lid will be vacuum formed. Thus, the extrusion grain can be taken advantage of, but it is not necessary as to the operability of the dome lid and the ability to fold back the tear-back flap. The extrusion grain is, however, more likely to be taken advantage of in the case of the dome lids of FIGS. 4 through 6. Indeed, the tear-back flap 82 may be defined when the dome lid 80 is first vacuum formed and the fault line 84 is stamped, by stamping the fault line so as to include the corners 85*a*, 85*b*, and so that the side edges 83*a*, 83*b* will be formed along the extrusion grain when the tear-back flap is folded back.

Other features and amendments to the structure of the disposable dome lid of the present invention may be utilized, as may be well known in those skilled in the art of designing and vacuum forming disposable lids for beverage cups, without departing from the spirit and scope of the accompanying claims.

What is claimed is:

1. A disposable dome lid for placement onto a drinking cup having an opening at its upper end, said opening being defined by a substantially circular cup rim whose upper extremity lies substantially in a single plane;

wherein said disposable dome lid is vacuum formed from extruded plastics sheet material, and comprises:

a substantially circular planar top surface, a side surface depending downwardly from said top surface, and a downwardly facing cup rim engaging recess formed near the outer periphery of said disposable dome lid;

wherein said cup rim engaging recess is defined at its outer side by a substantially circular, downwardly depending apron, and its inner side by a downwardly directed recess side wall;

wherein said recess side wall and said side surface both extend downwardly into an upwardly facing recess, and intersect at the bottom thereof;

wherein said substantially circular plan top surface is above said cup rim engaging recess;

wherein a portion of said substantially circular top surface is displaced and extends outwardly and terminates at a lower lip engaging surface having a side edge at each side thereof, and wherein said lower lip engaging surface depends downwardly from said top surface and merges at each side edge with said side surface, and is above said cup rim engaging recess; and wherein a depressed "U"-shaped hinge is formed in said top surface and is spaced away from and substantially parallel to said lower lip engaging surface, and fault lines are stamped into said substantially planar top surface to define a tear-back flap which, when torn back, will fold backwardly at said "U"-shaped hinge and will thereby define a drink-through opening in said top surface in a region thereof adjacent said lower lip engaging surface.

2. The disposable dome lid of claim 1, wherein there are three fault lines comprising an outer fault line and two edge fault lines, wherein said outer fault line is stamped into said top surface in a position thereof near said lower lip engaging surface, and said two edge fault lines extend away from respective ends of said outer fault line towards said "U"-shaped hinge, and terminate thereat.

3. The disposable dome lid of claim 1, wherein an upwardly extending locking stub is formed in a region of said tear-back flap near the outer edge thereof, at a defined distance from said "U"-shaped hinge, and a locking recess is formed in said substantially planar top surface at substantially said defined distance away from said "U"-shaped hinge and at the opposite side thereof from said locking stub;

whereby when said tear-back flap is torn back by breaking said fault lines, and is folded about said "U"-shaped hinge, said locking stub will engage in said locking recess to secure said tear-back flap in a folded back position.

4. The disposable dome lid of claim 3, wherein at least one of the width across said locking stub and the length in a direction towards said "U"-shaped hinge, and a corresponding at least one of the width and length of said locking recess are chosen so that, when said locking stub is inserted into said locking recess, it will be retained therein by interference fit of the edges of each of said locking stub and said locking recess which define the respective width or length thereof.

5. The disposable dome lid of claim 1, wherein said lower lip engaging surface is slightly concave in plan view with respect to the outer periphery of said lid, so as to conform to the contour of the lower lip of a user when said disposable dome lid is in use on a drinking cup.

6. The disposable dome lid of claim 1, wherein there are three fault lines comprising an outer fault line and two edge fault lines, wherein said outer fault line is stamped into said top surface in a position thereof near said lower lip engaging surface, and said two edge fault lines extend away from respective ends of said outer fault line towards said "U"-shaped hinge, and terminate thereat; and wherein said lower lip engaging surface is slightly concave in plan view with respect to the outer periphery of said lid, so as to conform to the contour of the lower lip of a user when said disposable dome lid is in use on a drinking cup.

7. The disposable dome lid of claim 6, wherein said outer fault line is stamped so as to be slightly convex in plan view with respect to the outer periphery of said lid, and wherein each of said convex fault line and said concave lower lip engaging surface have essentially the same axis of symmetry, whereby said lower lip engaging surface and said outer fault line diverge in plan view away from each other about said axis of symmetry.

8. The disposable dome lid of claim 1, wherein each of said side surface and said lower lip engaging surface extends downwardly and outwardly from said top surface.

9. The disposable dome lid of claim 8, wherein said downwardly depending apron extends entirely around the outer periphery of said disposable dome lid, and said downwardly directed recess side wall is interrupted by said lower lip engaging surface, whereby a plug fit of said disposable dome lid to a drinking cup is assured except in the region of said lower lip engaging surface.

10. A disposable dome lid for placement onto a drinking cup having an opening at its upper end, said opening being defined by a substantially circular cup rim whose upper extremity lies substantially in a single plane;

wherein said disposable dome lid is vacuum formed from extruded plastics sheet material, and comprises:

a substantially circular planar top surface, a side surface depending downwardly from said top surface, and a downwardly facing cup rim engaging recess formed near the outer periphery of said disposable dome lid;

wherein said cup rim engaging recess is defined at its outer side by a substantially circular, downwardly depending apron, and its inner side by a downwardly directed recess side wall;

wherein said recess side wall and said side surface both extend downwardly into an upwardly facing recess, and intersect at the bottom thereof;

wherein said substantially circular planar top surface is above said cup rim engaging recess;

wherein a portion of said substantially circular top surface is displaced and extends outwardly and terminates at a lower lip engaging surface having a side edge at each side thereof, and wherein said lower lip engaging surface depends downwardly from said top surface and merges at each side edge with said side surface and is above said cup rim engaging recess;

wherein a depressed "U"-shaped hinge is formed in said top surface and is spaced away from and substantially parallel to said lower lip engaging surface;

wherein a first fault line is stamped into said substantially planar top surface at the edge of said extended portion thereof so that said lower lip engaging surface substantially subtends said first fault line, and wherein said first fault line defines the outer extremity of a tear-back flap which, when torn back, will fold backwardly at said "U"-shaped hinge and will thereby define a drink-through opening in said top surface in a region thereof adjacent said lower lip engaging surface;

wherein an upwardly extending locking stub is formed in a region of said tear-back flap near the outer edge thereof, at a defined distance from said "U"-shaped hinge, and a locking recess is formed in said substantially planar top surface at substantially said defined distance away from said "U"-shaped hinge and at the opposite side thereof from said locking stub; and wherein the dimensions of said locking stub are such that the locking stub may be easily gasped between the thumb and a finger of an adult hand;

whereby said tear-back flap may be torn back by a grasping and lifting action of said locking stub so as to be folded backwardly about said "U"-shaped hinge.

11. The disposable dome lid of claim 10, wherein at least one edge surface of said locking stub has a ribbed configuration formed therein for greater stiffness thereof.

12. The disposable dome lid of claim 10, wherein said tear-back flap is defined at its out extremity by said first stamped fault line, and at its edges by two stamped edge fault lines which extend away from respective ends of said first fault line towards said "U"-shaped hinge, and terminate thereat.

13. The disposable dome lid of claim 10, when formed from an extruded plastics sheet material having a linear extrusion grain, wherein said "U"-shaped hinge and said first stamped fault line are molded and stamped, respectively, so as to be substantially perpendicular to said extrusion grain, and wherein said tear-back flap is defined at its outer extremity by said first stamped fault line and at its sides by tears which form along said extrusion grain at the respective sides thereof towards said "U"-shaped hinge.

14. The disposable dome lid of claim 10, wherein at least one of the width across said locking stub and the length in a direction towards said "U"-shaped hinge, and a corresponding at least one of the width and length of said locking recess are chosen so that, when said locking stub is inserted into said locking recess, it will be retained therein by interference fit of the edges of each of said locking stub and said locking recess which define the respective width or length thereof.

15. The disposable dome lid of claim 10, wherein matching depressions and pips are formed in edge surfaces of said locking stub and said locking recess, respectively, so as to more securely lock said tear-back flap into its folded back configuration.

16. The disposable dome lid of claim 10, wherein each of said side surface and said lower lip engaging surface extends downwardly and outwardly from said top surface.

17. The disposable dome lid of claim 16 wherein said downwardly depending apron extends entirely around the outer periphery of said disposable dome lid, and said downwardly directed recess side wall is interrupted by said lower lip engaging surface, whereby a plug fit of said disposable dome lid to a drinking cup is assured except in the region of said lower lip engaging surface.

18. The disposable dome lid of claim 10, wherein matching depressions and pips are formed in edge surfaces of said locking recess and said locking stub, respectively, so as to more securely lock said tear-back flap into its folded back configuration.

* * * * *